US005740726A

United States Patent [19]

Schwelling

[11] Patent Number: 5,740,726

[45] Date of Patent: Apr. 21, 1998

[54] WASTE MATERIAL PRESS WITH DISTANCE LEDGES AND RETAINING CLAWS

[76] Inventor: Hermann Schwelling, Hartmannweg 5, 88682 Salem, Germany

[21] Appl. No.: 576,805

[22] Filed: Dec. 21, 1995

[51] Int. Cl.[6] ..... B30B 15/00; B30B 9/30

[52] U.S. Cl. ..... 100/220; 100/255

[58] Field of Search ..... 100/220, 229 A, 100/240, 245, 250, 255

[56] References Cited

U.S. PATENT DOCUMENTS

| | | | |
|---|---|---|---|
| 379,414 | 3/1888 | Reeder | 100/220 |
| 532,750 | 1/1895 | Banister et al. | 100/220 |
| 3,903,790 | 9/1975 | Gladwin | 100/245 |
| 4,002,115 | 1/1977 | Nanoia | 100/220 |
| 4,182,236 | 1/1980 | Greer | 100/220 |
| 4,232,599 | 11/1980 | Ulrich | 100/220 |
| 5,062,358 | 11/1991 | Fox | 100/245 |

FOREIGN PATENT DOCUMENTS

| | | | |
|---|---|---|---|
| 2658337 | 7/1978 | Germany | 100/250 |

*Primary Examiner*—Stephen F. Gerrity
*Attorney, Agent, or Firm*—Friedrich Kueffner

[57] ABSTRACT

An arrangement of distance ledges and retaining claws in waste material presses for packaging cardboard, foils and similar used packaging materials, particularly in presses of upright construction, i.e., presses having a vertically acting pressure ram. Stationary distance ledges are provided on the rear wall and/or on the inner side of the front door in the filling area of the shaft of the press. In addition, retaining claws for the material already compressed in the lower shaft portion or the finished bale which has not yet been tied are pivotally mounted in openings of the rear wall and the front door of the pressing area of the shaft.

6 Claims, 2 Drawing Sheets

WASTE MATERIAL PRESS WITH DISTANCE LEDGES AND RETAINING CLAWS

BACKGROUND OF THE INVENTION

1. Field of the Invention

The present invention relates generally to waste material presses. Specifically, the present invention relates to the simultaneous arrangement of distance ledges and retaining claws in waste material presses for packaging cardboard, foils and similar used packaging materials, particularly in presses of upright construction, i.e., presses having a vertically acting pressure ram.

2. Description of the Related Art

Waste material presses of this type are well known. These waste material presses have in the area of the filling shaft distance ledges which have the purpose of preventing waste material from reaching between the pressure plate and the pressing shaft wall during the pressing stroke. In addition, these known waste material presses have in the pressing shaft retaining claws with projections which are directed in the pressing direction and which have the purpose of holding down the material which more or less expands again after the pressure release.

Particularly in presses for waste material from foils or materials having a different hardness or waste material having a high proportion of these materials, the material which expands again is ripped or torn by the rigid claws instead of being held down effectively in the filling shaft. Consequently, only small amounts of additional waste material could be filled in.

SUMMARY OF THE INVENTION

Therefore, it is the primary object of the present invention to provide a waste material press in which the above-described disadvantages are eliminated. Specifically, a novel type and arrangement of distance ledges and retaining elements is to be provided which hold even the material described above sufficiently down in the pressing shaft after the pressure is released.

In accordance with the present invention, stationary distance ledges are provided on the rear wall and/or on the inner side of the front door in the filling area of the shaft of the press. In addition, retaining claws for the material already compressed in the lower shaft portion or the finished bale which has not yet been tied are pivotally mounted in openings of the rear wall and the front door of the pressing area of the shaft.

Accordingly, the present invention is distinguished primarily by the combination of fixedly mounted distance ledges in the pressing shaft and retaining claws in the lower shaft portion which automatically pivot in and out of the shaft area.

This novel construction makes it possible to substantially better hold down the material previously compressed during each pressing stroke and then expanding after the pressure release, so that the filling shaft can be utilized almost completely for filling in waste material.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
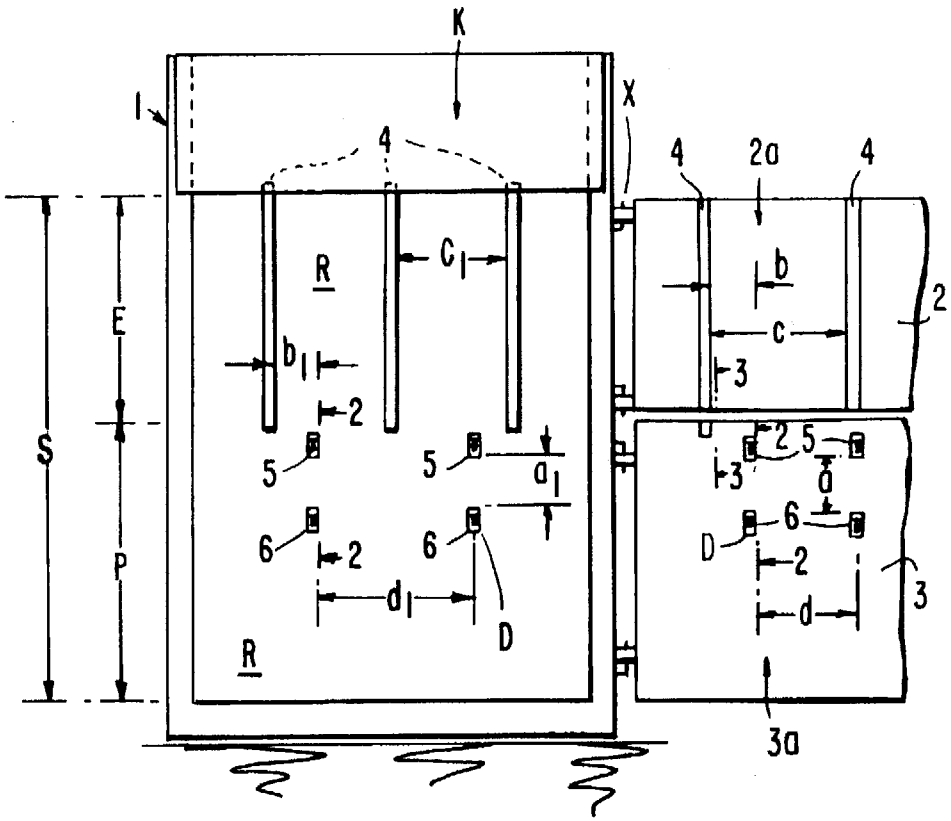
FIG. 1 is a partial front view of a waste material press with open front doors.

FIG. 1 of the drawing shows a waste material press according to the present invention with a rear wall R and a front door 2 in a filling area E and a front door 3 in a pressing area P.

Stationary distance ledges 4 are mounted on the rear wall R and/or the inner side 2*a* of the front door 2 in the filling area E of the shaft S of the press 1.

Retaining claws 5 and 6 for material which has already been compressed in the lower shaft area P or for the finished bale which has not yet been tied are mounted so as to be pivotable in openings D of the rear wall R and the front door 3 of the pressing area P.

Figure 3:
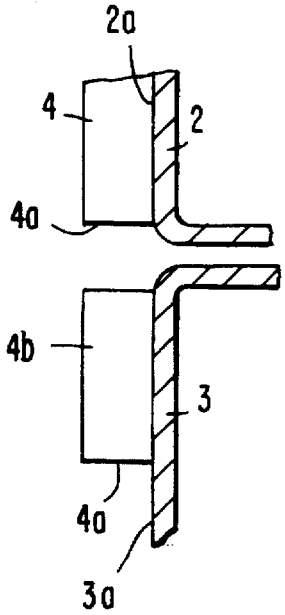
FIG. 3 is a sectional view, also on a larger scale, taken along sectional line 3—3 of FIG. 1.

In the waste material press according to the present invention, the following structural features are of significance. The distance ledges 4 are arranged horizontally spaced apart from each other by the distance c and $c_1$ and the free ends 4*a* thereof are essentially constructed with an obtuse angle, as shown in FIG. 3. The distance ledges 4 extend over the entire height of the front door 2 of the filling area E and continue as short separate ledge pieces 4 in the upper portion of the pressing shaft door 3.

The different lateral spacings c and $c_1$ of the distance ledges 4 on the shaft rear wall R and the front door inner side 2*a* are structurally required in view of the arrangement and construction of the retaining claws 5 and 6 to be described in detail below.

Figure 2:
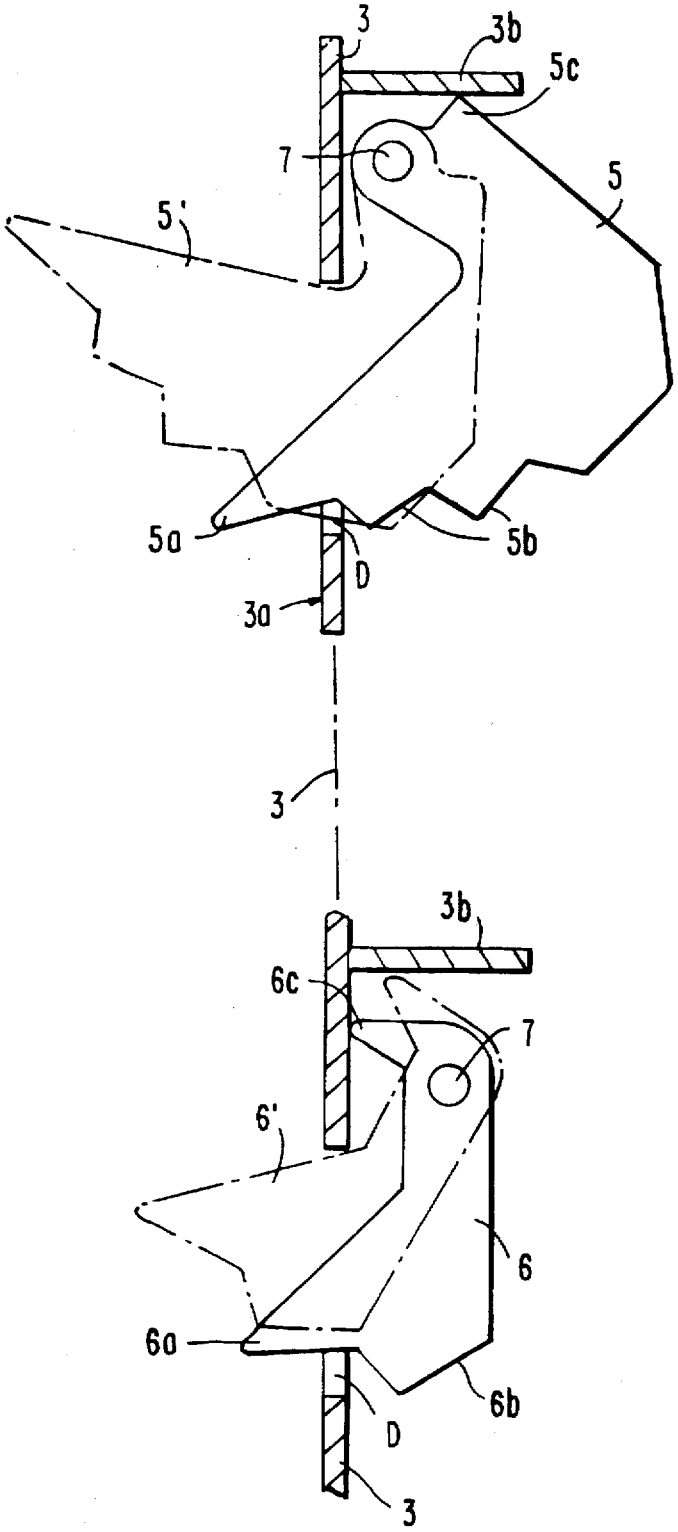
FIG. 2 is a sectional view, on a larger scale, taken along sectional line 2—2 of FIG. 1.

The retaining claws 5 and 6 are suspended from horizontal pivot bolts 7 in the openings D so as to be freely pivotable into the pressing area P, as shown in FIG. 2. In the unloaded state, only the projections 5*a* and 6*a* of the retaining claws 5 and 6 extend into the shaft 5. The retaining claws 5 and 6 are arranged on the front door 3 and the shaft rear wall R with different lateral spacings d and $d_1$ and vertical spacings a and $a_1$ relative to each other and laterally offset relative to the distance ledges 4 by distances b and $b_1$.

Another important feature of the waste material press 1 according to the present invention is the fact that the retaining claws 5 and 6 are differently shaped and have a stepped or toothed bottom side 5*b* and 6*b*, respectively, and the retaining claws 5 and 6 are each arranged at least in pairs next to each other and parallel one below the other, wherein the upper row of retaining claws 5 is located above the lowermost position of the pressure ram K.

Since the retaining claws 5 of the upper row of claws have the larger dimensions, these claws 5 are pivoted by the expanding material to a greater extent into the pressing shaft P than do the lower retaining claws 6, as illustrated in broken lines 5' and 6', respectively, in FIG. 2, and provide sufficient support for the upper side of the bale. Limiting stops 5*c* and 6*c* represent the respective end positions of the free mobility of the claws 5 and 6.

Finally, to make it possible that the pressure ram K can extend as close as possible to the shaft walls, the pressure plate is provided with recesses, not shown, which correspond to the ledges 4 and the claws 5, 6.

The invention is not limited by the embodiments described above which are presented as examples only but can be modified in various ways within the scope of protection defined by the appended patent claims.

I claim:

1. A waste material press comprising a rear wall, side walls and first and second front doors, the rear wall, the side walls and the front doors forming an essentially rectangular filling shaft and an essentially rectangular pressing shaft below the filling shaft, the first front door being part of the filling shaft and the second front door being part of the pressing shaft, and a pressure ram vertically movable in the filling and pressing shafts, stationary distance ledges mounted at least one of at the rear wall and the first front door, the rear wall and the second front having openings, retaining claws extending into the pressing shaft being pivotally mounted in the openings for holding down any waste material compressed in the pressing shaft or a finished bale which has not been tied.

2. The waste material press according to claim 1, wherein the distance ledges are horizontally spaced from one another, the spacer ledges having free ends, the free ends being essentially shaped with an obtuse angle, the first front door having a height, the spacer ledges extending over the height of the first front door, further comprising short separate spacer ledges in an upper portion of the second front door.

3. The waste material press according to claim 2, wherein the spacer ledges are spaced apart at different distances on the rear wall and on the first front door.

4. The waste material press according to claim 1, wherein the retaining claws are suspended from pivot bolts so as to be freely pivotable in the openings into the pressing shaft, the retaining claws having projections, wherein only the projections extend into the pressing shaft in an unloaded state, wherein the retaining claws are mounted on the second front door and the rear wall with different lateral spacings and different vertical spacings and laterally offset relative to the distance ledges.

5. The waste material press according to claim 4, wherein the vertically spaced retaining claws have different shapes, and wherein the retaining claws have stepped or toothed bottom sides.

6. The waste material press according to claim 4, wherein the retaining claws are mounted at least in pairs next to one another and parallel below one another, wherein an upper row of the retaining claws are located above a lowermost position of the pressure ram.

* * * * *